US008978615B2

(12) United States Patent
Fedotov

(10) Patent No.: US 8,978,615 B2
(45) Date of Patent: Mar. 17, 2015

(54) DEVICE FOR THE SEALED CONNECTION OF COMMUNICATING DUCTS IN ADJOINING AND/OR CONNECTED COMPONENTS OF AN INTERNAL COMBUSTION ENGINE

(71) Applicant: MAN Truck & Bus AG, Munich (DE)

(72) Inventor: Sergiy Fedotov, Nuremberg (DE)

(73) Assignee: MAN Truck & Bus AG, Munich (DE)

( * ) Notice: Subject to any disclaimer, the term of this patent is extended or adjusted under 35 U.S.C. 154(b) by 0 days.

(21) Appl. No.: 14/155,750

(22) Filed: Jan. 15, 2014

(65) Prior Publication Data

US 2014/0197634 A1 Jul. 17, 2014

(30) Foreign Application Priority Data

Jan. 15, 2013 (DE) ..... 10 2013 000 510

(51) Int. Cl.
*F01M 1/02* (2006.01)
*F02F 11/00* (2006.01)
*F01M 11/00* (2006.01)

(52) U.S. Cl.
CPC ..... *F02F 11/00* (2013.01); *F01M 11/00* (2013.01)
USPC ..... 123/196 R

(58) Field of Classification Search
CPC .... B29C 65/56; B29C 65/562; B29C 65/565; B29C 66/10; B29C 66/13; B29C 66/1312
USPC ..... 123/196 R, 1 R; 285/397, 239, 370, 285/133.21, 133.6
See application file for complete search history.

(56) References Cited

U.S. PATENT DOCUMENTS 6,418,911 B1 * 7/2002 Augustin ..... 123/468

FOREIGN PATENT DOCUMENTS

DE 10 2004 037 054 A1 3/2006

* cited by examiner

*Primary Examiner* — Hung Q Nguyen
(74) *Attorney, Agent, or Firm* — Lucas & Mercanti, LLP

(57) ABSTRACT

A device for the sealed connection of communicating ducts in adjoining components or an internal combustion engine includes a connecting pipe inserted into the ducts and which has a pipe portion which projects into a first component. A sealing ring is disposed between the pipe portion and an associated duct wall of the first component. The connecting pipe furthermore has an annular collar accommodated in a duct-side recess of the second component, wherein an axially sealing second sealing ring is arranged between a face-side portion of the annular collar and a wall region of a duct-side recess, the annular collar accommodated in the recess with a radial circumferential gap.

10 Claims, 5 Drawing Sheets

DEVICE FOR THE SEALED CONNECTION OF COMMUNICATING DUCTS IN ADJOINING AND/OR CONNECTED COMPONENTS OF AN INTERNAL COMBUSTION ENGINE

CROSS-REFERENCE TO RELATED APPLICATIONS

This application claims the priority of DE 10 2013 000 510.8 filed Jan. 15, 2013, the priority is hereby claimed incorporated by reference herein.

BACKGROUND OF THE INVENTION

The present invention relates to a device for the sealed connection of communicating ducts in adjoining and/or connected components of an internal combustion engine, in particular of communicating ducts in a crankcase and an oil sump of an internal combustion engine, as per the preamble of patent claim 1.

DE 10 2004 037 054 A1, for example, discloses a generic sealing device in which a connecting pipe with a sealing ring is used in ducts provided in flange regions of components of an internal combustion engine. Aside from generating the sealed connection of the ducts which conduct lubricating oil, for example, such connecting pipes also act as centering sleeves which, in a manner which facilitates assembly, also permit a defined assignment of the components to be connected. Tolerance compensation transversely with respect to the longitudinal axis of the connecting pipe is scarcely possible here without inadmissible warping of the sealing device. In the case of certain components of internal combustion engines, however, there is the problem that, in a further flange plane which is for example perpendicular to the first flange plane, components must be connected which span the components joined together with the connecting pipe via the first flange plane (for example a timing sprocket cover, a clutch housing, a flywheel housing, etc.). Here, leaks and/or component warping may arise as a result of flange surfaces which are not in exact alignment.

SUMMARY OF THE INVENTION

It is an object of the invention to propose a device, which is simple in structural and manufacturing terms, for the sealed connection of communicating ducts in adjoining and/or connected components of an internal combustion engine, in particular of communicating ducts in a crankcase and an oil sump of an internal combustion engine, which device, while providing reliable sealing, permits a defined degree of tolerance compensation in the direction of the flange plane of the components with the connecting pipe.

According to a first embodiment of the invention, a device for the sealed connection of communicating ducts in adjoining and/or connected components of an internal combustion engine, in particular of communicating ducts in a crankcase and an oil sump of an internal combustion engine, includes a connecting pipe inserted into the ducts and which in turn has a pipe portion which projects into a first component, between which pipe portion and an associated duct wall of the first component there is arranged a radially sealing sealing ring. The connecting pipe furthermore has an annular collar which is accommodated in a duct-side recess of the second component. An axially sealing second sealing ring is arranged between a face-side portion of the annular collar and a wall region of the duct-side recess, wherein the annular collar is furthermore accommodated in the recess with a radial circumferential gap.

By means of the circumferential gap, tolerance compensation can be provided in the sealing plane without the sealing action of the sealing ring which acts in the axial direction being impaired. Here, the centering action of the connecting pipe which simplifies the assembly of the components, and a simple arrangement of the sealing rings on the connecting pipe, are substantially maintained. The connecting pipe may alternatively also be referred to as a connecting sleeve.

Furthermore, with the joining-together of the components, the annular collar is held in the connecting or flange plane in the axial direction and with a defined seal contact pressure, while the tubular portion of the connecting pipe may be of thin-walled form, thus permitting expedient duct cross sections with small dimensions.

The solution according to the invention can thus serve in a highly effective manner as a compensator for relative displacements between a crankcase and an oil sump, for example for the situation of different thermal expansions of the components and/or in the case of a deformation during engine operation, for example a deformation resulting from a freely suspended transmission.

The axially acting second sealing ring could basically be formed, for example, by a flat or areal sealing ring. Particularly preferable for a particularly good sealing action, however, is an embodiment in which, in a manner advantageous from a manufacturing aspect, an annular groove is provided in the face-side portion of the annular collar, into which annular groove the second sealing ring, which has an axially sealing action, is inserted. Here, the annular groove may be designed such that the sealing ring is not only situated loosely therein but rather is also retained therein.

As an alternative to this, it may however also be provided that, on the face-side portion of the annular collar, there is formed a projection which runs around thereon at least in sections, preferably annularly, and by means of which the second sealing ring, which has an axially sealing action, can be held on the face-side portion, in particular held there in a secure manner in terms of assembly with a defined preload. Here, the projection is preferably formed, from a manufacturing and assembly aspect, such that, at its outer circumference, it tapers conically toward the annular collar. It is then possible here for the associated sealing ring, which has an axial sealing action, to be simply stretched and fitted onto the projection. After the fitting, the sealing ring elastically contracts and is thereby retained on the projection, which yields a significant simplification of the assembly process, because the sealing ring is held captively on the annular collar during the connection or bringing-together of the two components. Furthermore, the projection is preferably formed so as to rest on the inner edge region of the face-side portion of the annular collar and/or, by way of its inner circumference, forms a constituent part of a pipe wall of the connecting pipe. This yields a stepless region on the duct side and a compact overall construction.

Furthermore, in a particularly preferred embodiment, the first sealing ring, which has a radially sealing action, may be arranged in a secure manner in terms of assembly in a duct-wall-side annular groove of the associated duct. The duct-side recess is formed, in a simple manner in terms of manufacturing, by a widening, which is of step-shaped cross section, in the mouth region of the duct of the second component.

It is particularly preferable for the first component to be a crankcase of an internal combustion engine and for the second component to be an oil sump and/or a lower crankcase bearing part and/or a cylinder head of an internal combustion engine. The assembly process may then be inter alia the insertion of the connecting pipe into the duct of the crankcase, and with pre-centering by the connecting pipe or by the annular collar, the mounting onto the further component, for example the oil sump. The tolerance compensation by means of the circumferential gap which is provided may be realized with the mounting of the further attachment part, for example a timing sprocket cover, or if appropriate by means of a measurement tool or a gauge.

Finally, the ducts which receive the connecting pipe may be oil suction ducts and/or oil return ducts of a lubricating oil system of the internal combustion engine. Furthermore, the ducts could if appropriate also serve for the transfer of cooling water in a liquid-cooled internal combustion engine.

BRIEF DESCRIPTION OF THE DRAWINGS

An exemplary embodiment of the invention will be explained in more detail on the basis of the appended schematic drawing, in which.

DETAILED DESCRIPTION OF THE PREFERRED EMBODIMENTS

Figure 1:
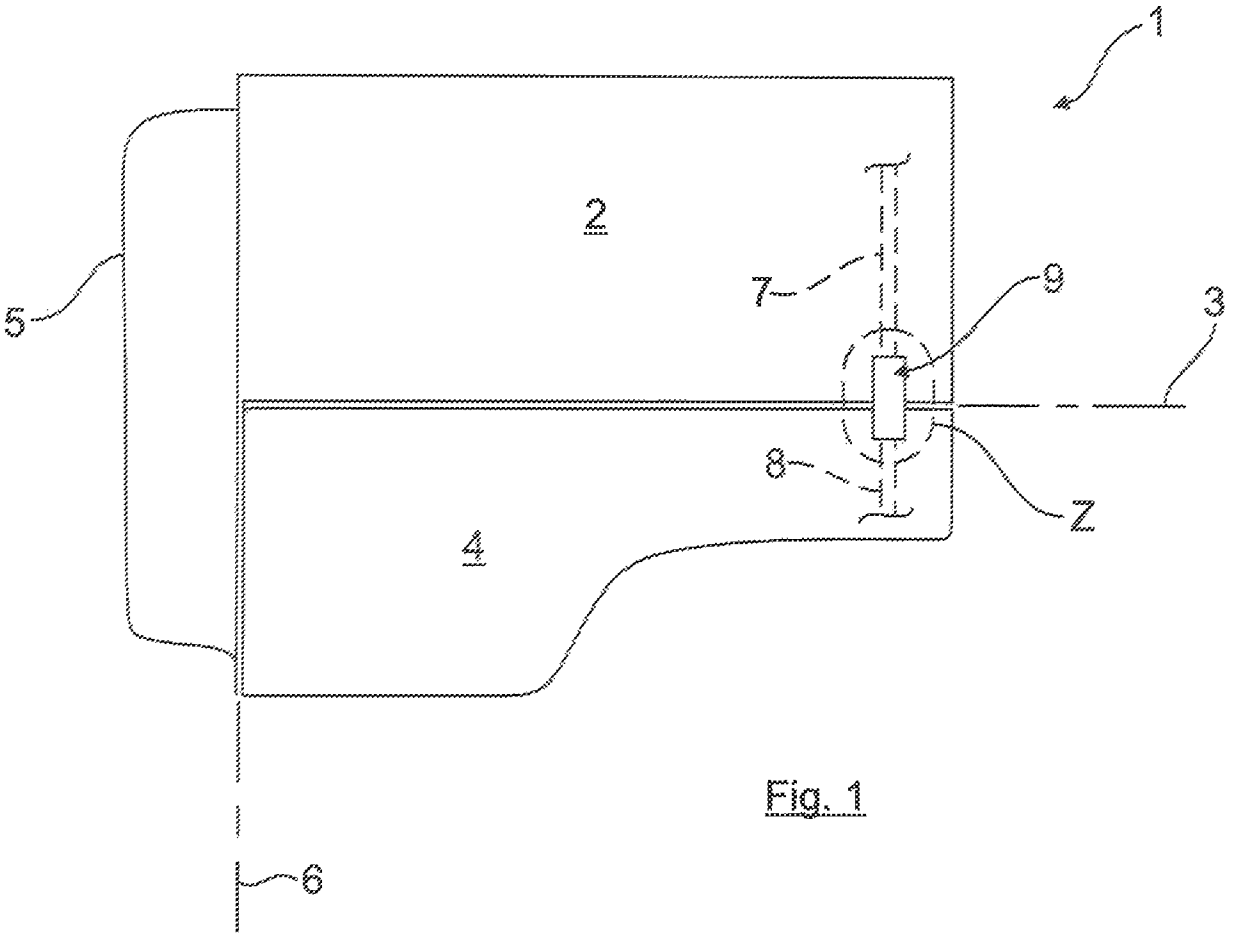
FIG. 1 is a diagrammatic illustration of an internal combustion engine having a crankcase, having an oil sump flange-mounted thereon, having a flywheel housing arranged in a second flange plane, and having a connecting pipe which bridges ducts in the flange plane between the crankcase and oil sump.

FIG. 1 shows, merely to the extent necessary for the understanding of the present invention, an internal combustion engine 1 with a crankcase or cylinder crankcase 2 on which an oil sump 4 is flange-mounted in a first, approximately horizontal flange plane 3.

Flange-mounted on the internal combustion engine 1 at the power output side is a flywheel housing 5 whose flange plane 6 runs approximately vertically and, as can be seen, spans corresponding flange regions both of the crankcase 2 and also of the oil sump 4. For this purpose, the crankcase 2 and the oil sump 4 have, correspondingly to the horizontal flange plane 3, flange regions oriented perpendicularly in the flange plane 6.

At least in a flange region between the crankcase 2 and the oil sump 4, ducts 7 and 8 are manufactured or produced which are oriented in alignment and perpendicular to the flange plane 3 and into which there is inserted a connecting pipe 9 which bridges the ducts 7 and 8. The connecting pipe 9 firstly seals off the ducts 7 and 8 to the outside and, during assembly, serves for the defined alignment of the oil sump 4 relative to the crankcase 2. The solution according to the invention can thus serve in a highly effective manner as a compensator for relative displacements between a crankcase and an oil sump, for example for the situation of different thermal expansions of the components and/or in the case of a deformation during engine operation, for example a deformation resulting from a freely suspended transmission.

The ducts 7 and 8 may form an oil suction duct for the suction of lubricating oil out of the oil sump 4, or an oil return duct. It is also possible for multiple ducts 7 and 8 to be provided with connecting pipes 9 in the flange plane 3.

Figure 2A:
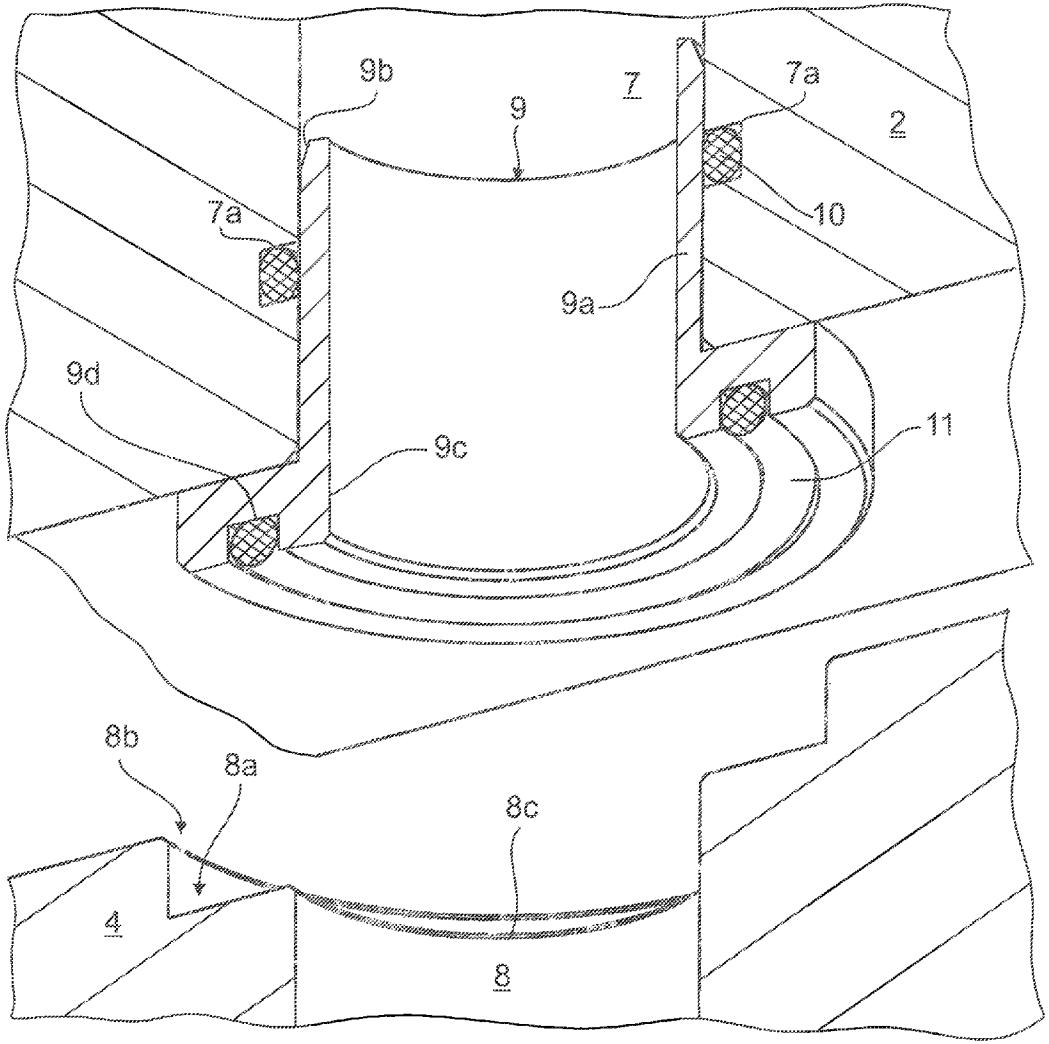
FIGS. 2*a*, 2*b* show a first embodiment of the detail Z of FIG. 1 in the exploded state (FIG. 2*a*) and in the assembled state (FIG. 2*b*)
Figure 2B:
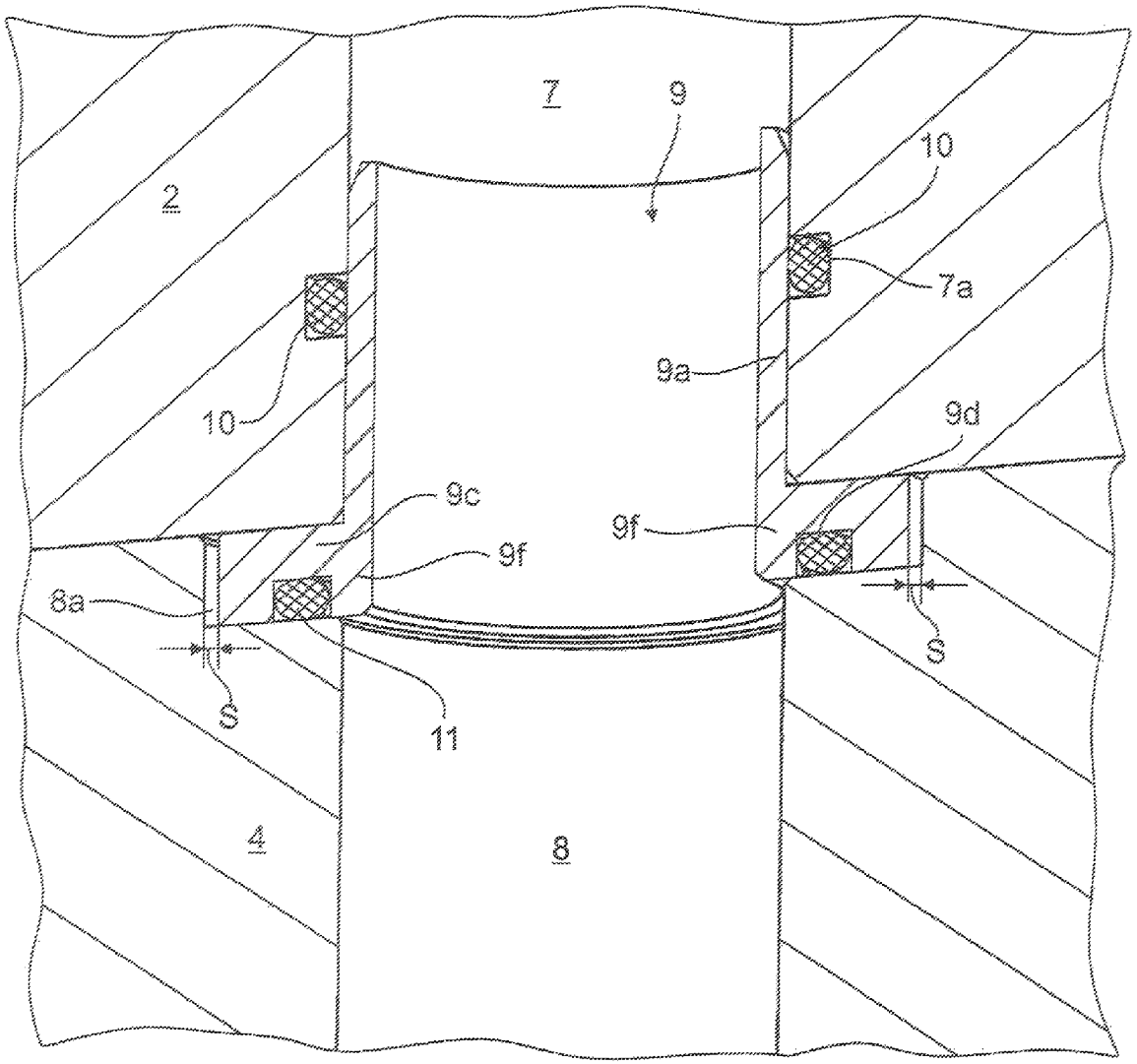

FIGS. 2*a*, 2*b* show, in an enlarged illustration, a first exemplary embodiment of the connecting pipe 9 which is inserted sealingly into the ducts 7 and 8 by means of two for example resiliently elastic sealing rings 10 and 11.

For this purpose, the connecting pipe 9 has a thin-walled pipe portion 9*a* with a chamfer 9*b* at the face side and with an annular collar 9*c* of larger diameter.

The pipe portion 9*a* projects into the duct 7 over a defined length, and in so doing, interacts with the sealing ring 10, which is inserted into an annular groove 7*a*, with a radially oriented sealing action. For the preloading of the sealing ring 10, the annular groove 7*a* is designed such that the sealing ring 10 projects beyond said annular groove to a predefined extent in the non-assembled state.

Furthermore, the annular collar 9*c* of the connecting pipe 9 is held in the axial direction in a recess 8*a*, which is widened in a step-shaped manner in cross section, of the duct 8 in the mouth region 8*b* of the duct 8 in the flange region of the oil sump 4, wherein the sealing ring 11 is inserted into an annular groove 9*a* of a face-side portion of the annular collar 9*c* and, in the assembled state, is preloaded with an axially oriented seal pressure (FIG. 2*b*). For this purpose, the sealing ring 11 projects beyond the annular groove 9*d* in the axial direction (FIG. 2*a*).

Furthermore, the annular groove 9*d* is dimensioned such that, even in the case of extreme radial displacements of the annular collar 9*c* at the circumferential gap side, its inner groove wall portion 9*f* bears and is supported reliably by way of its contact surface against the recess 8*a* or a duct-side edge region 8*c* of the recess 8*a*.

Between the recess 8*a* of the duct 8 in the oil sump 4 and the annular collar 9*c* of the connecting pipe 9, there is formed a radial circumferential gap s of defined size, which gap permits a displacement of the oil sump 4 relative to the crankcase 2 in the horizontal direction without the seal pressure at the sealing ring 11 being impaired.

During the mounting of the oil sump 4 onto the crankcase 2, after the sealing rings 10 and 11 are placed into the corresponding annular grooves 7*a*, 9*d*, the connecting pipe 9 is inserted into the duct 7, and then the oil sump 4, in a manner aligned by means of the annular collar 9*c* of the connecting pipe 9, is mounted in an upward vertical mounting direction, and is initially only loosely fixed.

Subsequently, it can be ensured for example by means of a gauge that the vertical flange regions, arranged in the flange plane 6 for the flywheel housing 5, of the crankcase 2 and oil sump 4 are in exact alignment with one another, wherein by means of the circumferential gap s at the connecting pipe 9, a small correction for compensating manufacturing tolerances can be carried out if necessary.

The further assembly process may be performed in a known manner.

Figure 3A:
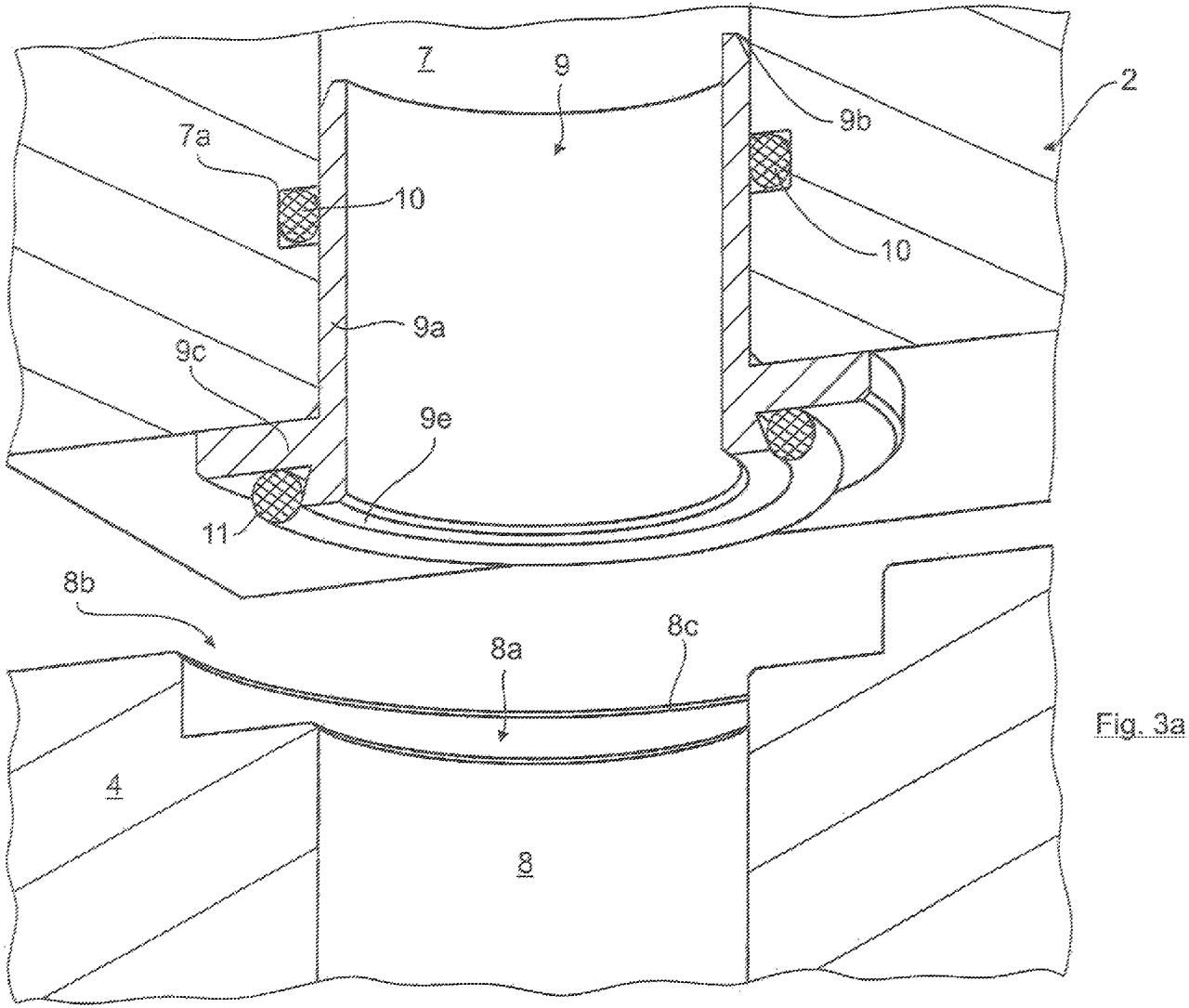
FIGS. 3*a*, 3*b* show an alternative embodiment of the detail Z of FIG. 1 in the exploded state (FIG. 3*a*) and in the assembled state (FIG. 3*b*).
Figure 3B:
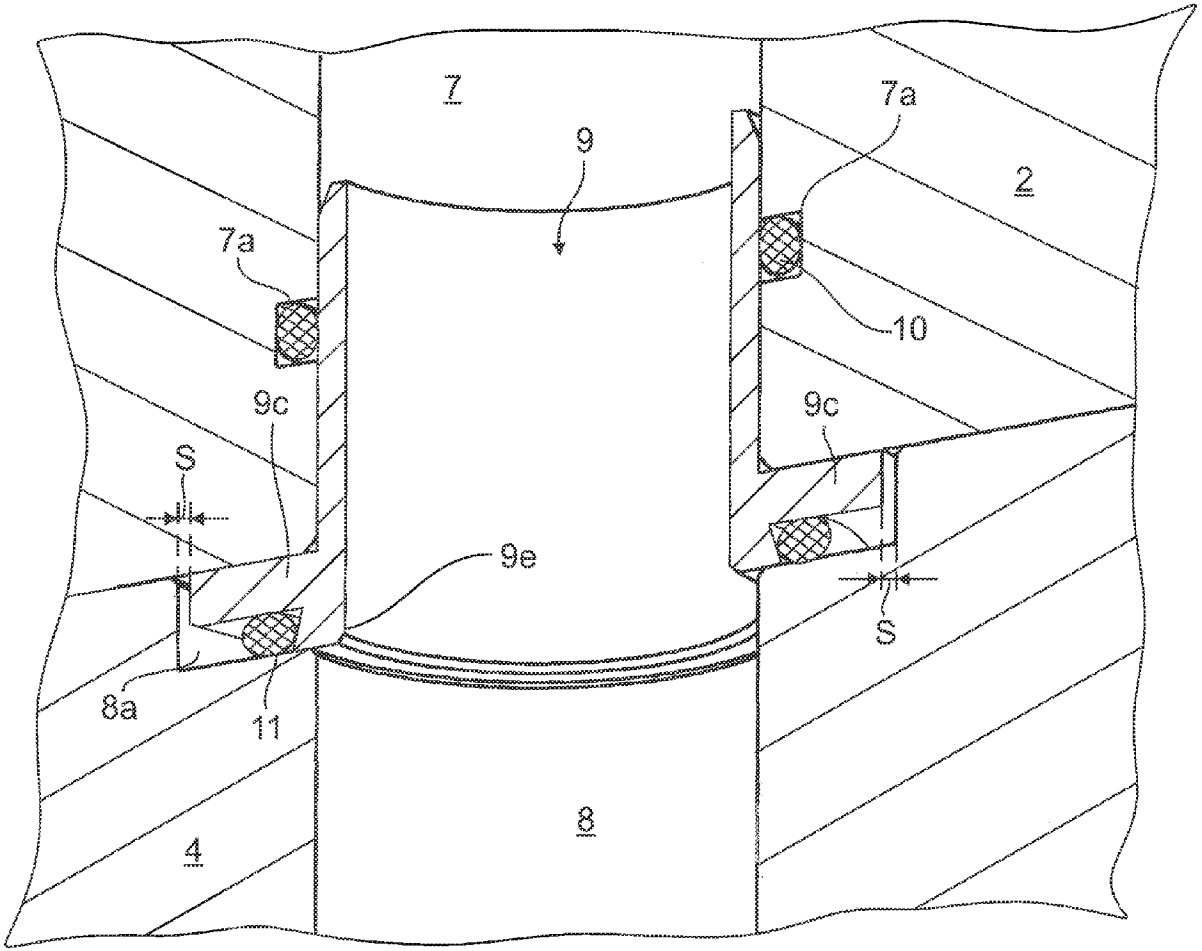

FIGS. 3*a*, 3*b* show an alternative embodiment of the connecting pipe 9, in which, on the face-side portion of the annular collar 9*c*, there is integrally formed a projection 9*e* which in this case is by way of example of annularly encircling form and fields the axially acting sealing ring 11. For secure hold against slippage, the projection 9*e* or the outer circumference thereof is designed to taper comically toward the annular collar 9*c*, whereby the sealing ring 11 is secured axially, similarly to the situation in a groove. The "groove" thus formed could also be of rounded form. As can also be seen, the projection 9*e* is formed and arranged such that its inner circumference forms a constituent part of the pipe wall of the connecting pipe 9.

The projection 9*e* is designed, with regard to its axial extent, such that it is ensured that the sealing ring 11 is compressed in the axial direction within the recess 8*a* of the duct 8 (see FIG. 3*b*), that is to say the sealing ring 11 projects beyond the projection 9*e* in the axial direction.

Furthermore, the projection 9*e* is dimensioned such that, even in the event of extreme radial displacements of the annular collar to at the circumferential gap side, it bears and is supported reliably against the recess 8*a* or a duct-side edge region 8*c* of the recess 8*a*. In other words, this means that the outer diameter of the projection 9*e* in the region of its receptacle-side contact surface is selected so as to be greater than the duct diameter in the region of the mouth opening of the duct 8.

The invention is not restricted to the exemplary embodiment illustrated. For example, as possible functional parts of the internal combustion engine instead of the oil sump 4, use may also be made of a cylinder head, a crankcase bearing housing, etc., which are provided with at least one connecting pipe 9 at the flange regions for the sealed connection of integrated ducts 7, 8 and which simultaneously serve for alignment during the assembly of the functional parts and subsequent tolerance compensation.

LIST OF REFERENCE SIGNS

1 Internal combustion engine
2 Crankcase
3 Horizontal flange plane
4 Oil sump
5 Flywheel housing
6 Vertical flange plane
7 Duct
7*a* Annular duct
8 Duct
8*a* Recess
8*b* Mouth region
8*c* Edge region
9 Connecting pipe
9*a* Pipe portion
9*b* Chamfer
9*c* Annular collar
9*d* Annular groove
9*e* Projection
9*f* Groove wall portion
10 Sealing ring
11 Sealing ring
s Circumferential gap

The invention claimed is:

1. A device for a sealed connection of a first duct in a first component and a second duct in a second component, the first component and the second component are adjoining components of an internal combustion engine, wherein the second component includes a duct-side recess, the device comprising:

a connecting pipe having a pipe portion inserted into the duct of the first component and an annular collar, wherein the annular collar is accommodated in the duct-side recess of the second component;

a radially sealing first sealing ring disposed between the pipe portion and a duct wall of the duct of the first component;

an axially sealing second sealing ring disposed between an axially-facing face-side portion of the annular collar and a wall region of the duct-side recess such that the second sealing ring is preloaded with an axially oriented seal pressure, wherein the annular collar is accommodated in the duct-side recess with a radial circumferential gap, whereby tolerance corrections are allowed for compensating manufacturing tolerances without impairing a sealing action of the axially sealing second sealing ring.

2. The device according to claim 1, wherein the face-side portion of the annular collar includes an annular groove into which the second sealing ring is inserted.

3. The device according to claim 1, wherein the face-side portion of the annular collar includes a projection which runs around thereon at least in sections, the second sealing ring being held on the face-side portion by the projection.

4. The device according to claim 3, wherein the projection is formed on the inner edge region of the face-side portion of the annular collar and, by or includes an inner circumference forming a constituent part of a pipe wall of the connecting pipe.

5. The device according to claim 3, wherein the projection has an outer circumference that tapers conically toward the annular collar.

6. The device according to claim 1, wherein the radially sealing first sealing ring is arranged in a duct-wall-side annular groove of the first duct.

7. The device according to claim 1, wherein the duct-side recess is formed by a widening with a step-shaped cross section, in a mouth region of the second duct.

8. The device according to claim 1, wherein the first component is a crankcase of the internal combustion engine, and the second component is one of an oil sump, a lower crankcase bearing part, and a cylinder head of the internal combustion engine.

9. The device according to claim 1, wherein the ducts which receive the connecting pipe are one of oil suction ducts and oil return ducts of a lubricating oil system of the internal combustion engine.

10. A vehicle having a device, a first component, and a second component according to claim 1.

* * * * *